US005144198A

United States Patent [19]

Itoh et al.

[11] Patent Number: 5,144,198

[45] Date of Patent: Sep. 1, 1992

[54] ELECTRON FEEDER FOR FLAT-TYPE LUMINOUS DEVICE

[75] Inventors: Shigeo Itoh; Mikio Yokoyama; Kazuhiko Tsuburaya, all of Mobara, Japan

[73] Assignee: Futaba Denshi Kogyo K.K., Mobara, Japan

[21] Appl. No.: 700,425

[22] Filed: May 15, 1991

Related U.S. Application Data

[63] Continuation of Ser. No. 390,219, Aug. 7, 1989, abandoned.

[30] Foreign Application Priority Data

Aug. 11, 1988 [JP] Japan ..... 63-200342

[51] Int. Cl.[5] ..... H01J 29/50; H01J 1/62; G09G 3/30

[52] U.S. Cl. ..... 313/422; 313/423; 313/414

[58] Field of Search ..... 313/422, 423, 414

[56] References Cited

U.S. PATENT DOCUMENTS

| | | | |
|---|---|---|---|
| 4,137,478 | 1/1979 | Credelle | 313/422 |
| 4,153,856 | 5/1979 | Siekanowicz et al. | 313/422 |
| 4,158,157 | 6/1979 | Schwartz | 313/422 |
| 4,335,332 | 6/1982 | Credelle | 313/422 |
| 4,577,133 | 3/1986 | Wilson | 313/422 |
| 4,641,058 | 2/1987 | Koshigoe et al. | 313/414 |
| 4,672,262 | 6/1987 | Stewart et al. | 313/422 |
| 4,752,721 | 6/1988 | Nishida et al. | 313/422 |
| 4,853,587 | 8/1989 | Lamport et al. | 313/422 |

*Primary Examiner*—Donald J. Yusko
*Assistant Examiner*—Brian Zimmerman
*Attorney, Agent, or Firm*—Oblon, Spivak, McClelland, Maier & Neustadt

[57] ABSTRACT

An electron feeder for a flat-type luminous device capable of providing electrons sufficient to ensure the uniform luminance of a whole display section irrespective of a distance from an electron source. A plurality of front electrodes and a plurality of rear electrodes constituting an electron beam guide are arranged separate from one another in the direction of traveling of the electrons, respectively, and the front electrode and rear electrode corresponding to each other constitute each guide electrode section. The so-constructed guide electrode sections are alternately applied thereto two different voltages, resulting in the electron beam guide exhibiting the function of focusing electrons.

4 Claims, 3 Drawing Sheets

ELECTRON FEEDER FOR FLAT-TYPE LUMINOUS DEVICE

This is a continuation of application Ser. No. 07/390,219, filed on Aug. 7, 1989 now abandoned.

BACKGROUND OF THE INVENTION

This invention relates to an electron feeder for a flat-type luminous device, and more particularly to an electron feeder which is used for a back light device or the like for a flat-type luminous device such as a flat-type display device adapted to display an image or a projected image or display letters, numerals or the like in a predetermined pattern, a non-luminous display device utilizing non-luminous means such as liquid crystal, or the like.

In general, a display device using a cathode ray tube has been conventionally used for displaying an image or a projected image, because a display device of this type carries out a color display with high luminance and high definition. However, a display device of the cathode ray tube type is highly complicated in structure to arrest the weight-saving and thinning of the display device, because it is required to have a considerable depth in order to accomplish the arrangement of an electron gun behind a display plane and the uniform high-voltage scanning of an electron beam between both ends of the display plane.

Also, a display device utilizing an electron excited phosphor is also used for this purpose. This type of display device includes a fluorescent display tube and a fluorescent display device to which the principle of the fluorescent display tube is applied. This fluorescent type of display device includes a thin boxlike envelope evacuated to a high vacuum. On an inner surface of the envelope or in proximity thereto is formed a display section which includes phosphor layers and anode conductors. Also, the device includes a plurality of filamentary cathodes stretchedly arranged opposite to the display section and adapted to emit electrons therefrom when they are electrically heated. Between the filamentary cathodes and the display section or between the filamentary cathodes and the envelope is arranged at least one control electrode, so that the control electrode or the control electrode and anode conductor cause electrons emitted from the filamentary cathodes to be selectively impinged on a desired position on the display section, resulting in a desired display. The application of a low voltage of, for example, several hundred volts or less to the anode conductor or the application of a high voltage of, for example, 5 to 10kV thereto is selectively carried out depending on a display to be desired.

In order to cause the so-constructed fluorescent display device to display an image or a projected image, many filamentary cathodes must be stretchedly arranged so as to prevent nonuniformity in the display and emit electrons sufficient for satisfactory luminescence. This causes an increase in power consumption of the filamentary cathodes and therefore an increase in power consumption of the whole display device. Also, the filamentary cathodes are generally stretched at a position opposite to the display device, therefore, to the filamentary cathodes is adhered a material produced by the decomposition of the phosphor due &o the impingement of electrons on the display section, resulting in the electron discharging capability of the filamentary cathodes being deteriorated. Also, the material causes an oxide formed on the filamentary cathode to be decomposed to produce a decomposition product, so that the product is adhered to an inner surface of the display section which decrease the luminous efficiency of the phosphor, thereby reducing the lifetime of the display device.

Further, in addition to the above-described display device of the cathode ray tube type and the fluorescent display device, a flat-type luminous device using an electron excited phosphor is proposed, which is generally constructed as shown in FIGS. 5(a) and 5(b).

FIG. 5(a) is a side elevation view in section showing such a flat-type luminous device and FIG. 5(b) is a sectional view showing an essential part of the device. The device includes a front cover 1 made of a light-permeable insulating material such as a glass plate or the like. On an inner surface of the front cover 1 are deposited phosphor layers of desired luminous colors and anode conductors of desired patterns, resulting in a display section 2. At a position opposite to the front cover 1 is arranged a rear plate 3 made of an insulating material such as a glass plate. The front cover 1 and rear plate 3 constitute an air-tight envelope in cooperation with side plates 11 by means of a sealing material. On an inner surface of the rear plate 3 is arranged an electron feeder comprising an electron source A and an electron beam guide B in a manner to positionally correspond to the display section 2. Electrons emitted from the electron feeder are selectively impinged on a desired position on the display section 2 by control electrodes 13 or the control electrodes 13 and anode conductors.

Now, the electron source A and electron beam guide B will be described in detail. The electron source A includes a filamentary cathode stretchedly arranged along one side of the flat-type luminous device for emitting electrons therefrom, a reflecting electrode 5 arranged adjacent to the filamentary cathodes 4 for forcing electrons toward the electron stream guide B, a drawing-out electrode 7 positioned opposite to the reflecting electrode 5 with the filamentary cathode 4 being interposed between the the reflecting electrode 5 and the drawing-out electrode 7 and formed at a central portion thereof with a slit-like or ladder-like aperture for drawing out electrons emitted from the cathodes 4 therethrough toward the electron beam guide B, a focusing electrode 6 including one electrode element or a plurality of electrode elements such as a first focusing electrode element 6*a*, a second focusing electrode element 6*b* and a third focusing electrode element 6*c* and adapted to focus electrons drawn out by the drawing-out electrode 7.

The electron beam guide B includes a front electrode 8 arranged in the direction in which the display section 2 extends and is formed with a plurality of apertures 8*a* and a plurality of rear electrodes 9 arranged along the direction of traveling of the electrons in a manner to be separated from one another.

The front electrode 8 and rear electrodes 9 each have applied thereto a guide voltage higher than a voltage applied to the filamentary cathodes 4 or equal thereto, so that electrons emitted from the electron source A and introduced through one end of the electron beam guide B thereinto may be guided toward the other end of the electron beam guide B. Also, the rear electrodes 9 are selectively applied thereto a voltage lower than the guide voltage constantly applied, to thereby induce the electrons in the direction of the display section 2.

The rear electrodes 9 may comprise a plurality of metal plates. Alternatively, &hey may be formed by depositing a conductive material directly on the rear plate 3.

As described above, the electron feeder for the flat-type luminous device shown in FIGS. 5(a) and 5(b) is so constructed that the electron source is provided with some focusing electrodes for focusing electrons emitted from the filamentary cathodes into a beam-like shape. However, the electron beam guide serves to form a uniform electric field in the guide to reduce an influence on electrons from the electron source by the electric fields of different electrodes, to thereby guide the electrodes in the guide toward the other end of the guide. Accordingly, in the conventional electron feeder, the electron beam guide is not constructed so as to positively focus the electrons.

Thus, the electrons emitted from the electron source are diffused due to a space-charge effect as they travel in the electron beam guide, resulting in flowing into the front electrode and rear electrodes. Accordingly, when the electron feeder is applied to a flat-type luminous device, the electron feeder provides a portion of the display section near the electron source with electrons sufficient for satisfactory luminescence. However, the amount of electrons flowing into the display device is decreased as a distance from the electron source is increased. Thus, the conventional electron feeder has a disadvantage in that the display by the luminous device is increased in luminance near the electron source and gradually darkened with a distance from the electron source, leading to unevenness in the display and non-uniform luminance. Also, electrons in an amount sufficient for the display are produced over only a small distance, resulting in a failure in the largesizing of a display device.

An increase in the number of focusing electrodes for the electron source contributes to the focusing of the electrons emitted from the electron source. However, this also causes an increase in the amount of electrons flowing into the focusing electrodes to decrease electrons flowing into the display section although the electrons are uniformed to some degree, to thereby fail to produce sufficient luminance.

SUMMARY OF THE INVENTION

The present invention has been made in view of the foregoing disadvantage of the prior art.

Accordingly, it is an object of the present invention to provide an electron feeder for a flat-type luminous device which is capable of providing electrons sufficient to ensure that a whole display section exhibits uniform luminescence irrespective of a distance from an electron source.

In accordance with the present invention, an electron feeder is provided which is used for a flat-type luminous device including an air-tight envelope having electrodes arranged therein and kept at a high vacuum and a display section arranged in the envelope and including a phosphor layer and an anode conductor. The electron feeder includes at least one electron source arranged in the envelope for emitting electrons therefrom and at least one electron beam guide arranged in the envelope for guiding electrons emitted from the electron source and introduced through one end thereof thereinto toward the other end thereof along a plane opposite to the display section. The electron beam guide includes at least a plurality of front electrodes positioned opposite to the display section and separated from one another in the direction of traveling of the electrons emitted from the electron source and a plurality of rear electrodes arranged in substantially parallel with the front electrodes and separated from one another in the direction of traveling of the electrons. At least one front electrode and at least one rear electrode positioned substantially corresponding to the front electrode constitutes a guide electrode section. These guide electrode sections have alternately applied thereto at least two different voltages in turn to guide the electrons toward the other end of the electron beam guide. The front electrodes and rear electrodes positioned in proximity to a position of the display section to be selected have applied thereto a deflecting voltage to induce the electrons from the electron feeder section to the display section.

In the electron feeder of the present invention constructed as described above, at least two different voltages are alternately applied to the guide electrode sections to form a number of electrostatic lenses in the electron beam guide, so that electrons emitted from the electron source are guided toward the other end of the electron beam guide while being focused by the electrostatic lenses.

BRIEF DESCRIPTION OF THE DRAWINGS

These and other objects and many of the attendant advantages of the present invention will be readily appreciated as the same becomes better understood by reference to the following description when considered in connection with the accompanying drawings, wherein.

DETAILED DESCRIPTION OF THE PREFERRED EMBODIMENTS

Figure 1:
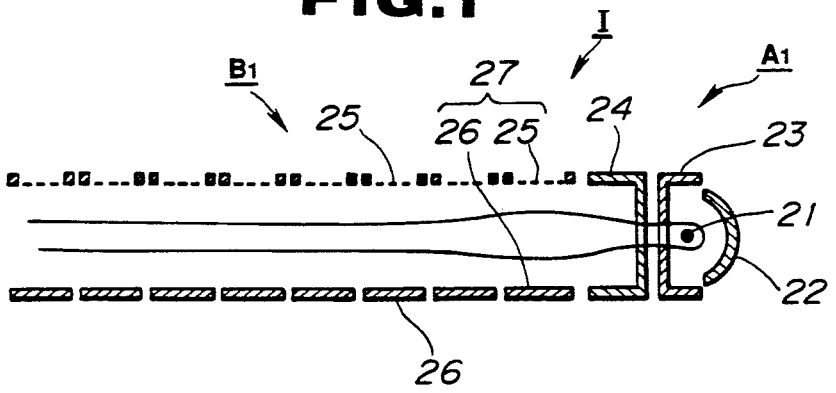
FIGS. 1 is a fragmentary sectional view showing an embodiment of an electron feeder for a flat-type luminous device according to the present invention.

Now, an electron feeder for a flat-type luminous device according to the present invention will be described hereinafter with reference to FIGS. 1 to 4(a), wherein like reference numerals designate like or corresponding parts throughout.

Figure 5A:
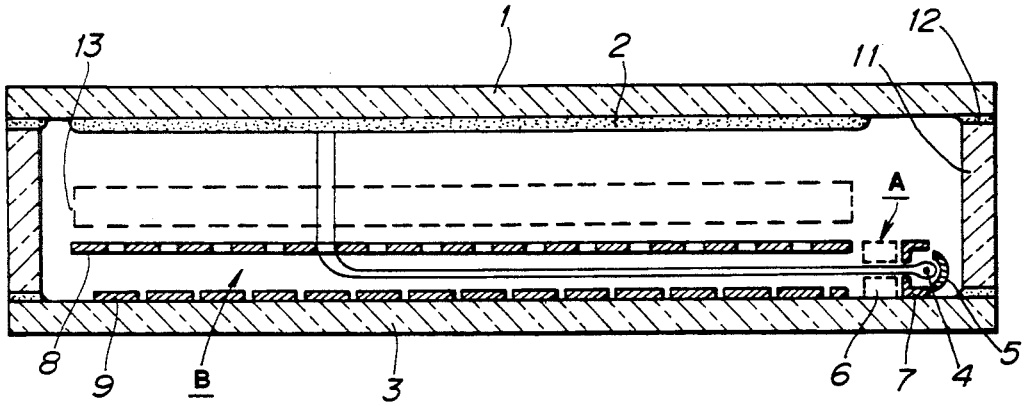
FIG. 5(a) is a vertical sectional view showing a flat-type luminous device in which a conventional electron feeder is arranged.
Figure 5B:
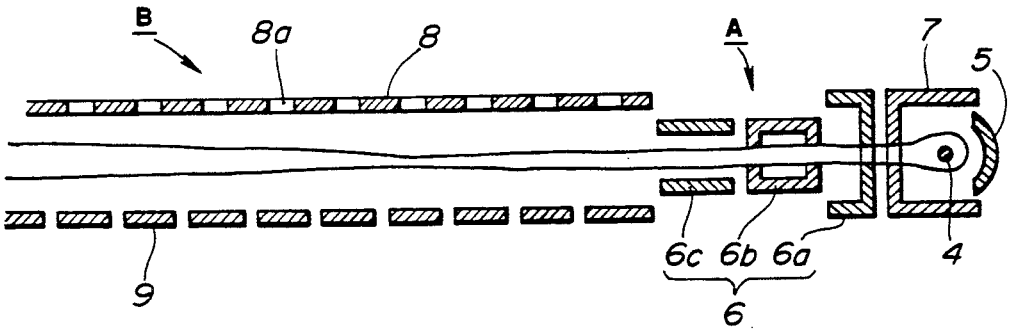
FIG. 5(b) is a fragmentary sectional view showing an essential part of the conventional electron feeder shown in FIG. 5(a).

FIG. 1 shows an embodiment of an electron feeder for a flat-type luminous device according to the present invention. An electron feeder of the illustrated embodiment is generally designated by reference character I, which includes at least one electron source A1 for emitting electrons converged into a substantially beam-like shape and at least one electron beam guide B1 for guiding the electrons emitted from the electron source A1 and introduced through one end of the guide B1 thereinto toward the other end of the beam guide B1. The electron feeder I is applied to a flat-type luminous device in a manner to be arranged on or near an inner surface of an envelope as in the conventional electron feeder described above with reference to FIGS. 5(a) and 5(b).

Now, the electron source A1 and electron beam guide B2 will be described in detail hereinafter. The electron source A1 includes a filamentary cathode 21 for emitting electrons therefrom which is stretchedly arranged in a manner to extend along one side of a flat-type luminous device to which the electron feeder is applied, a reflecting electrode 22 arranged adjacent to the tilamentary cathode 21 and adapted to force electrons emitted from the cathode toward the electron beam guide B1, a drawing-out electrode 23 positioned opposite to the reflecting electrode 22 with the filamentary cathode 21 being interposed between the drawing-out electrode 23 and the reflecting electrode 22 and formed at a central portion thereof with a slit-like or ladder-like aperture extending along the direction of stretching of the filamentary cathode 21 through which electrons emitted from the cathode 21 are drawn out toward the electron beam guide B1, and a focusing electrode 24 formed at a central portion thereof with a slit-like or ladder-like aperture as in the drawing-out electrode 23 and adapted to focus electrons emitted from the drawing-out electrode 23 to provide them with directivity.

The electron beam guide B1 includes a plurality of front electrodes 25 separated from each other and each made of a flat metal plate formed with a mesh-like aperture and a plurality of rear electrodes 26 separated from each other. The front electrodes 25 are positioned on the side of a display section of a fluorescent luminous device when the electron feeder is applied to the device and arranged in the direction of traveling of electrons emitted from the electron source A1. The rear electrodes 26 comprise a plurality of metal plates positioned opposite to the front electrodes 25 and separated from each other in the direction of traveling of the electrons. The front electrodes 25 and rear electrodes 26 are arranged at substantially the same intervals and parallel with each other. Each pair of the so-formed front electrode 25 and rear electrode 26 opposite to each other constitutes a guide electrode section 27.

Now, the manner of operation of the so-constructed electron feeder will be described hereinafter with reference to FIGS. 2(a) and 2(b).

Figure 2A:
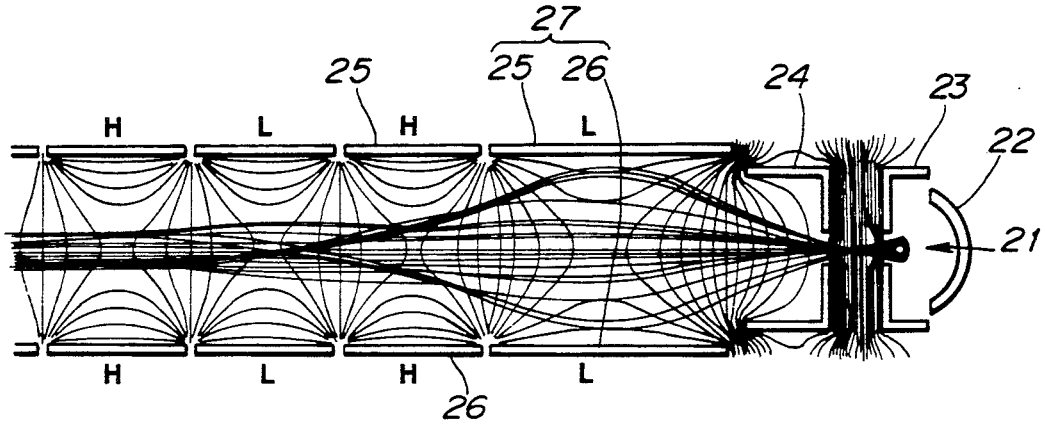
FIG. 2(a) is a schematic view showing the operation of the electron feeder shown in FIG. 1.
Figure 2B:
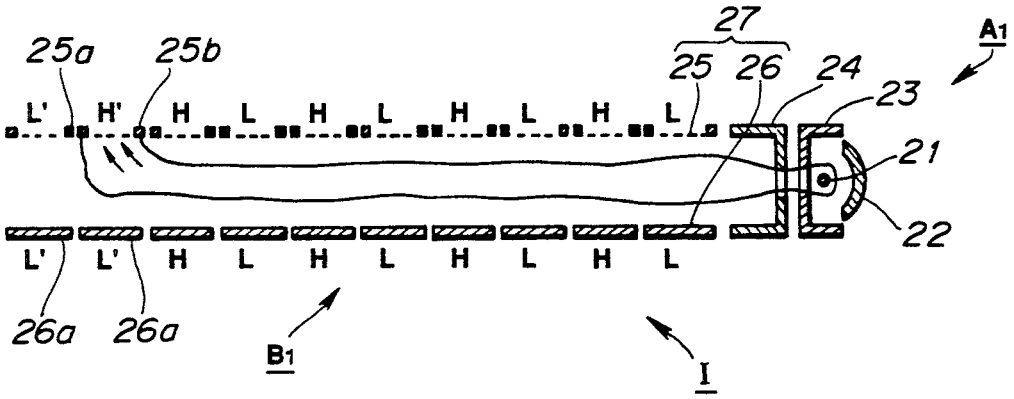
FIG. 2(b) is a fragmentary sectional view showing the operation of the electron feeder shown in FIG. 1.

FIG. 2(a) shows an example of an analysis of an electrical field formed when a predetermined voltage was applied to each of the electrodes of the electron feeder I, wherein the filamentary cathode 21, reflecting electrode 22, drawing-out electrode 23 and focusing electrode 24 were applied thereto voltages of 2 V, 0.2 V, 0 V and 100 V, respectively. In the electron beam guide B1, to the guide electrode section 27 nearest the electron source A1 is applied a low voltage L of, for example, 20 V and to the next guide electrode section 27 is applied a high voltage H of, for example, 100 V, resulting in the low voltage L and high voltage H being alternately applied in turn to the front electrodes 25 and rear electrodes 26 constituting the guide electrode sections 27 from the side of the electron source A1.

Thus, as shown in FIGS. 2(a), electrostatic lenses are formed at a boundary between the focusing electrode 24 of the electron source A1 and the guide electrode section 27 and at a boundary between each adjacent two guide electrode sections 27. The so-formed electrostatic lenses each permit electrons emitted from the electron source A1 to be guided toward the other end of the electron beam guide B1 without any diffusion.

Electrons traveling in the electron beam guide B1 are induced in the direction of a display section by applying a voltage L' of, for example, OV lower than the low voltage L of the guide electrode section 27 to the front electrode 25*a* and rear electrode 26*a* arranged in proximity to a position on the display section to be selected or slightly apart from the electron source A1 or by applying a voltage H' higher than the high voltage H of the guide electrode section 27 to the front electrode 25*b* opposite to the position on the display section to be selected. Alternatively, the guiding may be carried out by the application of a deflecting voltage obtained by combining both voltages.

Figure 3:
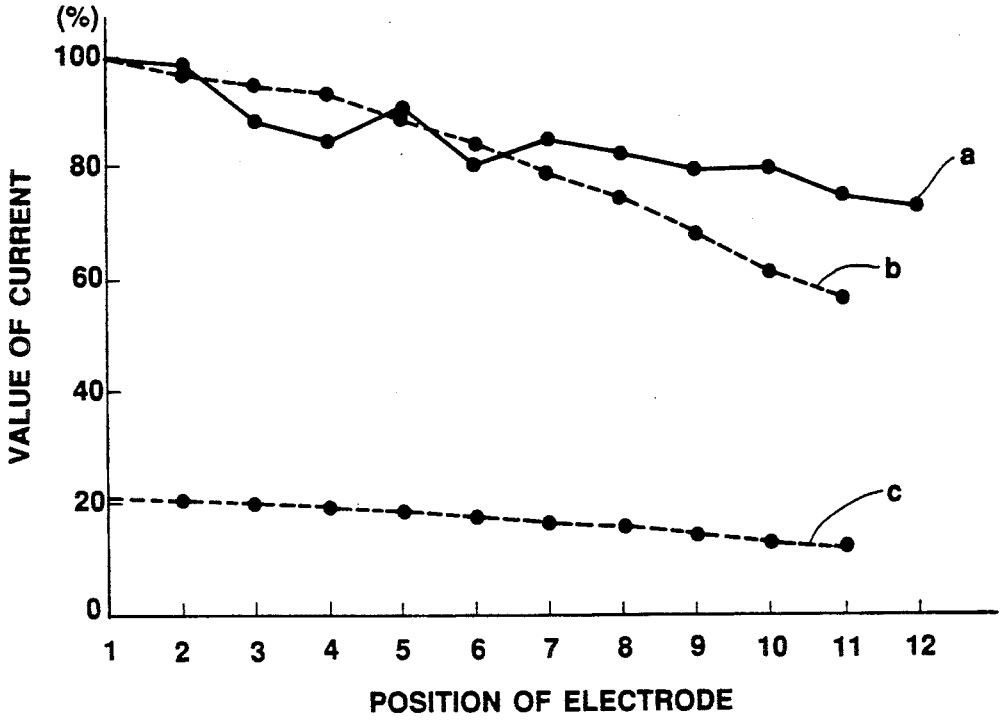
FIG. 3 is a graphical representation comparatively showing the focusing of electrons in an electron feeder.

FIG. 3 shows the comparison in focusing of electrons between the electron feeder shown in FIGS., 2(*a*) and 2(*b*) and the conventional electron feeder shown in FIGS. 5(*a*) and 5(*b*) which were driven under the same conditions.

In the conventional electron feeder, the front electrode was divided into a plurality of electrode elements for the purpose of facilitating the measuring, as in the illustrated embodiment. Also, in the conventional electron feeder, the electron source A includes additional focusing electrodes as compared with that in the illustrated embodiment. Accordingly, the common electrodes were driven under the same conditions. To the electron beam guide B of the conventional electron feeder was applied a guide voltage of 100 V. In each of both electron feeders B, a voltage of 200 V was applied to the front electrode to be selected and a voltage of OV was applied to the front electrodes and rear electrodes away from the electron source as compared with the front electrode and the rear electrode corresponding to the front electrode.

In FIG. 3, an axis of ordinates indicates a ratio between currents flowing through the selected front electrodes and an axis of abscissas indicates positions of the front electrodes wherein numeral 1 designates the front electrode nearest the electron source and number 12 indicates the front electrode furthermost from the electron source. A graph (a) indicates the focusing of electrons by the electron feeder of the illustrated embodiment and a graph (b) indicates the focusing of electrons by the conventional electron feeder, wherein a current flowing through the front electrode is relatively determined to be 100%. A graph (c) indicates a current flowing through the front electrode of the conventional electron feeder supposing that a current flowing through the front electrode of the electron feeder of the illustrated embodiment is determined to be 100%.

As will be noted from FIG. 3, the electron feeder I of the illustrated embodiment satisfactorily accomplishes the focusing of electrons as compared with the conventional electron feeder, because the former minimizes a decrease in current flowing through the front electrodes 25 apart from the electron source A1. Also, a relative current value in the electron feeder of the illustrated embodiment is five times as much as that in the conventional electron feeder.

As can be seen from the foregoing, the electron feeder I of the illustrated embodiment is so constructed that a plurality of the front electrodes 25 and a plurality of the rear electrodes 26 constituting the electron beam guide B1 are arranged separate from one another in the direction of traveling of the electrons, respectively, and the front electrode 25 and rear electrode 26 corresponding to each other constitute a guide electrode section 27. To the so-constructed guide electrode sections 27 are alternately applied at least two different voltages, resulting in the electron beam guide B1 exhibiting the function of focusing electrons.

Such a construction of the illustrated embodiment permits electrons emitted from the electron source A1 to be efficiently guided toward the other end of the electron beam guide B1, as well as the electron source A1 to be simplified in structure because it is not required to substantially focus the electrons. The simplification of the structure causes a reduction in the amount of electrons flowing into the electrodes of the electron source A1, resulting in an increase in the amount of electrons directed to the electron beam guide B1. Thus, the electron feeder of the illustrated embodiment supplies a portion of the display section apart from the electron source A1 with electrons in an amount sufficient for satisfactory luminescence.

Figure 4A:
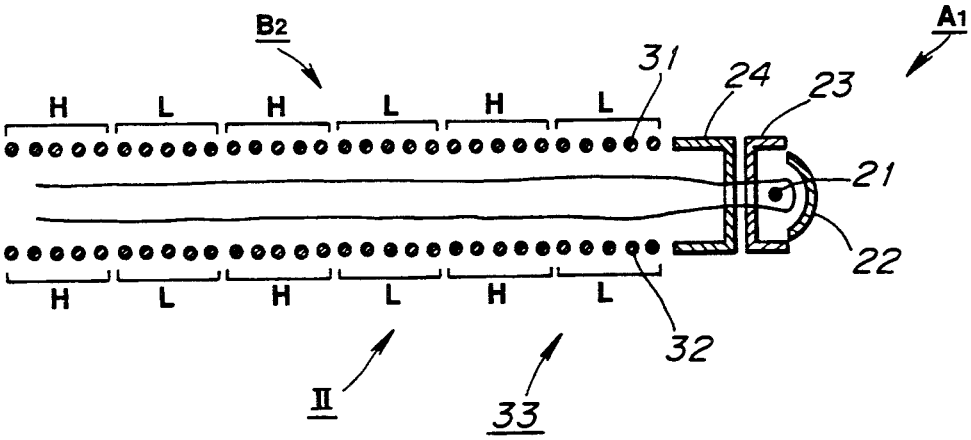
FIGS. 4(a) and 4(b) are fragmentary sectional views showing another embodiment of an electron feeder of a flat-type luminous device according to the present invention.
Figure 4B:
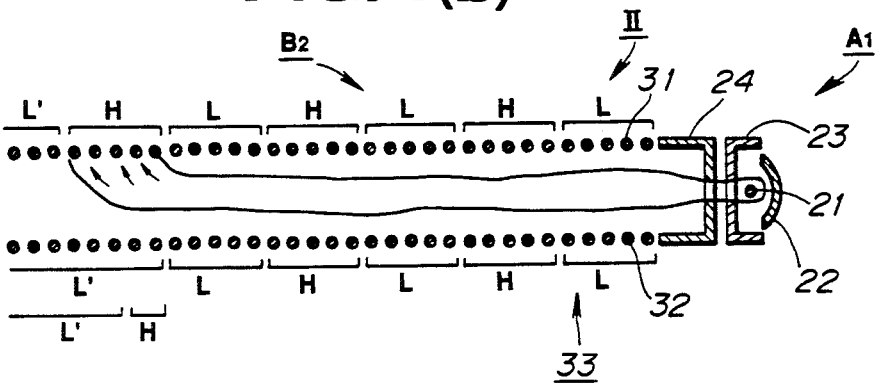

FIGS. 4(*a*) and 4(*b*) show another embodiment of an electron feeder according to the present invention. An electron feeder II comprises an electron source A1 and an electron beam guide B2. The electron source A1 is formed into substantially the same configuration as that in the embodiment described above. The electron beam guide B2 includes a plurality of wirelike front electrodes 31 stretchedly arranged opposite to the display section and in the direction perpendicular to a filamentary cathode 21 of the electron source A1 and a plurality of wire-like rear electrodes 32 arranged at substantially the same intervals as the front electrodes 31. In the soconstructed electron beam guide B2, each five of the front electrodes 31 and each five of the rear electrodes 32 constitute each guide electrode section 33 in order. To the guide electrode sections are alternately applied a low voltage L of, for example, 20 V and a high voltage H of, for example, 100 V, so that electrostatic lenses are formed in the electron beam guide B2 which function to focus electrons emitted from the electron source A1 and introduced them through one end of the guide B2 thereinto and guide them toward the other end thereof while preventing diffusion of the electrons. Also, to the front electrodes 31 and rear electrodes 32 positioned in proximity to the display section is applied a low voltage L' lower than the low voltage L applied to the guide electrode sections 33 to induce the electrons through gaps between the front electrodes 31 toward the display section. The voltage L' may be applied to each five front electrodes 31 and rear electrodes 32 constituting the guide electrode section 33. Alternatively, the application of the voltages may be carried out, for example, in such a manner that the voltage H or L is applied to each two electrodes of the guide electrode section 33 and the low voltage L' is applied to the remaining each three electrodes of the guide electrode section.

Each of the guide electrodes sections 33 may be constituted by, for example, each three front electrodes and rear electrodes 32. Also, the front electrodes 31 and rear electrodes 32 each may be stretched at equal intervals. Alternatively, the electrodes constituting each guide electrode section 33 may be arranged at equal intervals, whereas the intervals between the guide electrode sections 33 may be varied.

In the above-described embodiments, the configuration of each electrode of the electron beam guide may be suitably selected so long as they do not adversely affect the electron focusing and inducing actions of the electron beam guide. For example, the rear electrodes and front electrodes each may be formed into a plate-like shape and the front electrodes each may be formed into a wire-like shape. The rear electrodes may be formed by depositing a conductive material on an envelope of a fluorescent display device when the electron feeder of the present invention is applied to the fluorescent display device. Also, in the embodiments described above, the electron source includes the filamentary cathode. However, it may comprise a plurality of means for emitting electrons from substantially one point which are arranged in a row, like an electron gun used for a display device of the cathode ray tube type.

The above-described embodiments each are so constructed that two different voltages are alternately applied to the guide electrode sections of the electron beam guide. However, so long as high and low voltages are applied to the sections in an alternate manner, three or more voltages different from one another may be applied to the sections. Also, in the above-described embodiments, the application of the voltages to the guide electrode sections starts from the application of the low voltage to the guide electrode section nearest the electron source. However, it may be carried out in such a manner that a high voltage is applied to the nearest guide electrode section and then a low voltage is applied to the next guide electrode section, so long as the high voltage is lower than a voltage applied to the final electrode (focusing electrode) of the electron source. Also, the electron feeder of the present invention can be directed to a wide variety of applications. For example, it can be applied to a flat-type luminous device used for the display of an image or a projected image, the display of letters, numerals or the like in a predetermined pattern, or a back light device for a non-luminous device using liquid crystal.

As can be seen from the foregoing, the electron feeder of the present invention includes at least one electron source arranged in the envelope of the flat-type luminous device for emitting electrons therefrom and at least one electron beam guide arranged in the envelope for guiding electrons emitted from the electron source and introduced through one end thereof thereinto toward the other end thereof along a plane opposite to the display section of the luminous device. The electron beam guide includes at least a plurality of front electrodes positioned opposite to the display section and separated from one another in the direction of traveling of the electrons emitted from the electron source and a plurality of rear electrodes arranged in substantially parallel with the front electrodes and separated from one another in the direction of traveling of the electrons. At least one front electrode and at least one rear electrode positioned substantially corresponding to the front electrode constitute a guide electrode section. The guide electrode sections are alternately applied thereto two or more different voltages in turn to guide the electrons toward the other end of the electron beam guide. The front electrodes and rear electrodes positioned in proximity to a position of the display section to be selected are applied thereto a deflecting voltage to induce the electrons from the electron feeder section to the display section.

Such a construction of the present invention permits a number of electrostatic lenses to be formed in the electron beam guide which are sufficient to cause the electron beam guide to exhibit an electron focusing action, so that electrons emitted from the electron source may be efficiently guided toward the other end of the electron beam guide. Also, the construction minimizes a necessity of the electron focusing action of the electron source, to thereby cause the structure of the electron source to be simplified. This results in the amount of electrons flowing from the electrodes of the electron source to lead to an increase in the amount of electrons flowing toward the electron beam guide. Thus, the electron feeder of the present invention provides a portion of the display section apart from the electron source with electrons sufficient to ensure satisfactory luminescence, to thereby contribute the display of the luminous device with high luminance and without unevenness.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. An electron feeder for a flat-type luminous device including an air-tight envelope having electrodes arranged therein and kept at a high vacuum and a display section arranged in said envelope and including a phosphor layer and an anode conductor, comprising:

at least one electron source arranged in said envelope for emitting electrons therefrom and at least one electron beam guide arranged in said envelope for guiding electrons emitted from said electron source and introduced through one end thereof thereinto toward the other end thereof along a plane opposite to said display section;

said electron beam guide including at least a plurality of front wire electrodes positioned opposite to said display section and separated from one another in the direction of traveling of the electrons emitted from said electron source and a plurality of rear wire electrodes arranged in parallel with said front wire electrodes and separated from one another in the direction of traveling of said electrons, said plurality of front wire electrodes and said plurality of rear wire electrodes forming a plurality of guide electrode sections, each said guide electrode section constituted by a predetermined number of said front wire electrodes and a predetermined number of said rear wire electrodes facing said predetermined number of front wire electrodes;

said guide electrode sections comprising means for alternately applying thereto at least two different voltages to adjacent electrode sections to guide said electrons toward the other end of said electron beam guide;

said front wire electrodes and said rear wire electrodes positioned in proximity to a position of said display section are selected to have applied thereto a deflecting voltage to induce said electrons from said electron feeder section to said display section.

2. An electron feeder for a flat-type luminous device including an air-tight envelope having electrodes arranged therein and kept at a high vacuum and a display section arranged in said envelope and including a phosphor layer and an anode conductor, comprising:

at least one electron source arranged in said envelope for emitting electrons therefrom and at least one electron beam guide arranged in said envelope for guiding electrons emitted from said electron source and introduced through one end thereof thereinto toward the other end thereof along a plane opposite to said display section;

a focusing electrode positioned between and adjacent to said electron source and said electron beam guide;

said electron beam guide including at least a plurality of front wire electrodes positioned opposite to said display section and separated from one another in the direction of traveling of the electrons emitted from said electron source and a plurality of rear electrodes arranged in parallel with said front electrodes and separated from one another in the direction of traveling of said electrons;

said plurality of front electrodes and said plurality of rear electrodes forming a plurality of guide electrode sections, each said guide electrode section constituted by at least one said front electrode and at least one said rear electrode facing said at least one said front electrode;

said guide electrode sections comprising means for alternatively applying thereto at least two different voltages to adjacent electrode sections to guide said electrons toward the other end of said electron beam guide, said at least two different voltages comprising a first voltage and a second voltage, said first voltage being higher than said second voltage;

said front electrodes and rear electrodes positioned in proximity to a position of said display section selected to have applied thereto a deflecting voltage to induce said electrons from said electron feeder section to said display section;

a voltage applied to said focusing electrode being higher than said first voltage.

3. An electron feeder for a flat-type luminous device including an air-tight envelope having electrodes arranged therein and kept at a high vacuum and a display section arranged in said envelope and including a phosphor layer and an anode conductor, comprising:

at least one electron source arranged in said envelope for emitting electrons therefrom and at least one electron beam guide arranged in said envelope for guiding electrons emitted from said electron source and introduced through one end thereof thereinto toward the other end thereof along a plane opposite to said display section;

said electron beam guide including at least a plurality of front mesh electrodes positioned opposite to said display section and separated from one another in the direction of traveling of the electrons emitted from said electron source and a plurality of rear planar electrodes arranged in parallel with said front mesh electrodes and separated from one another in the direction of traveling of said electrons, said plurality of front mesh electrodes and said plurality of rear planar electrodes forming a plurality of guide electrode sections, each said guide electrode section being constituted by a predetermined number of said front mesh electrodes and a single of said rear planar electrodes facing said predetermined number of front mesh electrodes;

said guide electrode sections comprising means for alternately applying thereto at least two different voltages to adjacent electrode sections to guide said electrons toward the other end of said electron beam guide;

said front mesh electrodes and said rear planar electrodes positioned in proximity to a position of said display section are selected to have applied thereto a deflecting voltage to induce said electrons from said electron feeder section to said display section.

4. An electron feeder for a flat-type luminous device including an air-tight envelope having electrodes arranged therein and kept at a high vacuum and a display section arranged in said envelope and including a phosphor layer and an anode conductor, comprising:

at least one electron source arranged in said envelope for emitting electrons therefrom and at least one electron beam guide arranged in said envelope for guiding electrons emitted from said electron source and introduced through one end thereof thereinto toward the other end thereof along a plane opposite to said display section;

a focusing electrode positioned between and adjacent to said electron source and said electron beam guide;

said electron beam guide including at least a plurality of front mesh electrodes positioned opposite to said display section and separated from one another in the direction of traveling of the electrons emitted from said electron source and a plurality of rear planar electrodes arranged in parallel with said front mesh electrodes and separated from one another in the direction of traveling of said electrons;

said plurality of front mesh electrodes and said plurality of rear planar electrodes forming a plurality of guide electrode sections, each said guide electrode section being constituted by a predetermined number of front mesh electrodes and at least one of said rear planar electrodes facing said predetermined number of said front mesh electrodes;

said front electrode sections comprising means for alternately applying thereto at least two different voltages to adjacent electrode sections to guide said electrons toward the other end of said electron beam guide, said at least two different voltages comprising a first voltage and a second voltage, said first voltage being higher than said second voltage;

said front mesh electrodes and rear planar electrodes positioned in proximity to a position of said display section selected to have applied thereto a deflecting voltage to induce said electrons from said electron feeder section to said display section;

a voltage applied to said focusing electrode being higher than said first voltage.

* * * * *